US009330860B2

(12) United States Patent
Seo

(10) Patent No.: US 9,330,860 B2
(45) Date of Patent: May 3, 2016

(54) HANDLE OPERATING DEVICE FOR CIRCUIT BREAKER

(71) Applicant: LSIS CO., LTD., Anyang-si, Gyeonggi-do (KR)

(72) Inventor: Jae Kwan Seo, Cheongju-si (KR)

(73) Assignee: LSIS CO., LTD., Anyang-si (KR)

( * ) Notice: Subject to any disclaimer, the term of this patent is extended or adjusted under 35 U.S.C. 154(b) by 31 days.

(21) Appl. No.: 14/308,277

(22) Filed: Jun. 18, 2014

(65) Prior Publication Data

US 2015/0129403 A1 May 14, 2015

(30) Foreign Application Priority Data

Nov. 11, 2013 (KR) ..... 10-2013-0136460

(51) Int. Cl.

| | |
|---|---|
| ***H01H 3/20*** | (2006.01) |
| ***H01H 3/46*** | (2006.01) |
| *H01H 71/52* | (2006.01) |
| *H01H 3/32* | (2006.01) |

(52) U.S. Cl.

CPC ..... *H01H 3/46* (2013.01); *H01H 71/521* (2013.01); *H01H 2003/323* (2013.01); *H01H 2221/024* (2013.01); *H01H 2227/034* (2013.01)

(58) Field of Classification Search

CPC ..... H01H 3/04; H01H 3/08; H01H 3/32; H01H 3/46; H01H 2003/323; H01H 9/22

USPC ..... 200/330, 331, 332

See application file for complete search history.

(56) References Cited

U.S. PATENT DOCUMENTS

| | | | |
|---|---|---|---|
| 3,272,953 | A | 9/1966 | Tillson |
| 3,609,261 | A | 9/1971 | Rys |

FOREIGN PATENT DOCUMENTS

| | | |
|---|---|---|
| DE | 3033024 | 3/1981 |
| DE | 10-2007-014098 | 9/2008 |
| JP | 59-63945 | 4/1984 |
| JP | 2-113614 | 9/1990 |
| JP | 2003-297217 | 10/2003 |

(Continued)

OTHER PUBLICATIONS

Korean Intellectual Property Office Application Serial No. 10-2013-0136460, Office Action dated Oct. 20, 2014, 4 pages.

(Continued)

*Primary Examiner* — Vanessa Girardi

(74) *Attorney, Agent, or Firm* — Lee, Hong, Degerman, Kang & Waimey; Jonathan Kang; Harry Lee

(57) ABSTRACT

The present disclosure relates to a handle operating device for a circuit breaker, and there is provided a handle operating device including a connecting rod configured to transfer power for operating a manual operating handle that manually operates the on/off of a circuit breaker from the outside; a movable frame connected to the connecting rod to be movably coupled to an outer surface of a circuit breaker case in a direction parallel to the operating direction of the manual operating handle; a movable member provided at the movable frame in an interlocking manner to move the manual operating handle; a slot hole is formed on the moving member in an inclined manner from the moving direction of the manual operating handle; and a fastening member fastened to the movable member and movable frame through the slot hole.

7 Claims, 6 Drawing Sheets

(56) References Cited

FOREIGN PATENT DOCUMENTS

| | | |
|---|---|---|
| JP | 2011-070240 | 4/2011 |
| KR | 20-0251100 | 11/2001 |
| KR | 10-1105212 | 1/2012 |
| WO | 2015/026530 | 2/2015 |

OTHER PUBLICATIONS

European Patent Office Application Serial No. 14175529.8, Search Report dated Mar. 18, 2015, 6 pages.

Japan Patent Office Application Serial No. 2014-125087, Office Action dated Mar. 10, 2015, 2 pages.

Korean Intellectual Property Office Application Serial No. 10-2013-0136460, Notice of Allowance dated May 4, 2015, 2 pages.

HANDLE OPERATING DEVICE FOR CIRCUIT BREAKER

CROSS-REFERENCE TO RELATED APPLICATIONS

Pursuant to 35 U.S.C. §119(a), this application claims the benefit of earlier filing date and right of priority to Korean Patent Application No. 10-2013-0136460, filed on Nov. 11, 2013, the contents of which are all hereby incorporated by reference herein in their entirety.

BACKGROUND OF THE INVENTION

1. Field of the Invention

The present disclosure relates to a handle operating device for a circuit breaker for enhancing operational reliability when adjusting an operating distance of a handle in a large capacity circuit breaker.

2. Description of the Related Art

In general, circuit breaker is a device for automatically breaking an electrical circuit to prevent damage due to an overload or short circuit in the circuit, and a manual operating handle is provided at one side of a case thereof to manually operate it from the outside.

The circuit breaker may be divided into a small capacity circuit breaker and a large capacity circuit breaker according to the capacity of a current flowing through a main circuit thereof. In case of a small capacity circuit breaker, an operating load for operating the manual operating handle is not so large that it is not hard to manually operate the handle, but in case of a large capacity circuit breaker, a handle operating load is about five times higher than that of the small capacity circuit breaker, and thus it is difficult to manually operate the handle.

Accordingly, for the convenience of operating a circuit breaker, an external operating handle is further provided at the outside thereof in addition to the manual operating handle, and a mechanical mechanism is connected between the external operating handle and the manual operating handle of the circuit breaker, thereby allowing the manual operating handle of the circuit breaker to be easily operated by the external operating handle.

FIG. 1 is a perspective view illustrating a handle operating device of a large capacity circuit breaker in the related art, in which a movable frame 11 is provided on an outer surface of a circuit breaker case 10, and a connecting rod 12 is connected to the movable frame 11.

The movable frame 11 receives power from the connecting rod 12 to be rotated to a predetermined angle, thereby moving a handle 13 of the circuit breaker from an on position to an off position or vice versa.

FIG. 2 is a schematic view for explaining a power transfer mechanism to a handle of the circuit breaker in a handle operating device of a large capacity circuit breaker in the related art, and referring to FIG. 2, a movable member 14 is disposed in the middle of the movable rod provided in a lateral direction on a movable frame to rotate the handle of the circuit breaker in the left and right directions.

On the other hand, slot holes 15 are formed at both sides of the movable member 14, and a person installing a circuit breaker may adjust the location of screws 16 fastened through the slot holes 15 within a movable range of the slot holes 15 to finely adjust the width, thereby enhancing the operational reliability of the external operating handle.

However, according to a handle operating device of the large capacity circuit breaker, a direction in which the length of the slot hole 15 is formed in an elongated manner and the acting direction of a force transferred to the movable frame through a connecting rod 12 are the same as a direction parallel to the operating direction of a circuit breaker handle 13, and thus contrary to his or her intention during the operation of the circuit breaker handle 13, it occurs a phenomenon that the screw 16 is pushed toward one side by an operating force "F" being transferred to the movable member 14 through the connecting rod 12 from the external operating handle.

Though a screw head may not be pushed around the slot hole 15 by increasing the fastening force of the screw 16 to prevent the screw from being pushed toward one side, a cross groove formed on the screw head may be easily worn out when excessively rotating the screw 16, thereby aggravating the operating distance fine adjustment of the handle 13 as well as the dismantling of the damaged screw 16.

Accordingly, for this reason, hexagonal wrench bolts (a hexagonal groove is formed on the bolt head) having an excellent fastening force compared to typical screws 16 may be employed. In this case, hexagonal wrench bolts are highly expensive compared to typical screws 16, thereby increasing cost.

SUMMARY OF THE INVENTION

The present disclosure is contrived to solve the foregoing problems, and a technical task of the present disclosure is to provide a handle operating device for a circuit breaker for reducing a load on screws during the operation of a handle of the circuit breaker to prevent the screws from being pushed out as well as allowing the use of low cost screws instead of high cost hexagonal wrench bolts.

In order to accomplish the foregoing first technical task, according to an aspect of the present disclosure, there is provided a circuit breaker including a connecting rod, a movable frame, a movable member, a slot hole and a fastening member.

The connecting rod may transfer power for operating a manual operating handle that manually operates the on/off of a circuit breaker from the outside.

The movable frame may be connected to the connecting rod, and movably coupled to an outer surface of a circuit breaker case in a direction parallel to the operating direction of the manual operating handle.

The movable member may be provided at the movable frame in an interlocking manner to move the manual operating handle.

The slot hole may be formed on the moving member in an inclined manner from the moving direction of the manual operating handle.

The fastening member may be fastened to the movable member and movable frame through the slot hole.

According to an aspect of the present disclosure, the length direction of a slot hole may be disposed to be inclined at a predetermined angle from the moving direction of the manual operating handle to reduce a load on screws during the operation of a handle contrary to the related art, thereby preventing the screws from being pushed out as well as allowing the use of low cost screws.

Here, the fastening member may be a screw.

The fastening member may finely adjust an operating distance of the manual operating handle according to a position at which the fastening member is fixed on the slot hole.

The movable frame may include side plates and movable rods.

The side plates may be coupled to an outer surface of the circuit breaker case, respectively, with a hinge structure, and connected to an end portion of the connecting rod to be rotated in the same direction as that of the operating direction of the manual operating handle.

The movable rods may be connected between the side plates to be operated along with the side plates.

The movable member may be connected between the movable rods.

The movable member may be provided with an insertion hole therein to insert part of the manual operating handle so as to be connected to the manual operating handle.

The movable members may be disposed to be separated from each other for the manual operating handle therebetween, and moved in the operating direction of the manual operating handle.

The slot holes may be formed in parallel to each other with a gap therebetween.

According to a first embodiment, the slot holes may be formed on the movable member to be separated from each other in the vertical direction of the movement of the movable member.

According to a second embodiment, the slot holes may be formed on the movable member to be separated from each other in the movement direction of the movable member.

As described above, in a handle operating device for a circuit breaker according to the present disclosure, a load on screws during the operation of a handle of the circuit breaker may be reduced to prevent the screws from being pushed out, thereby enhancing the operational reliability of an external operating handle. Furthermore, the use of low cost screws may be allowed instead of high cost hexagonal wrench bolts, thereby achieving cost reduction.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

Hereinafter, a preferred embodiment of the present disclosure will be described in detail with reference to the accompanying drawings to such an extent that the present disclosure can be easily implemented by a person having ordinary skill in the art to which the present disclosure pertains.

Figure 1:
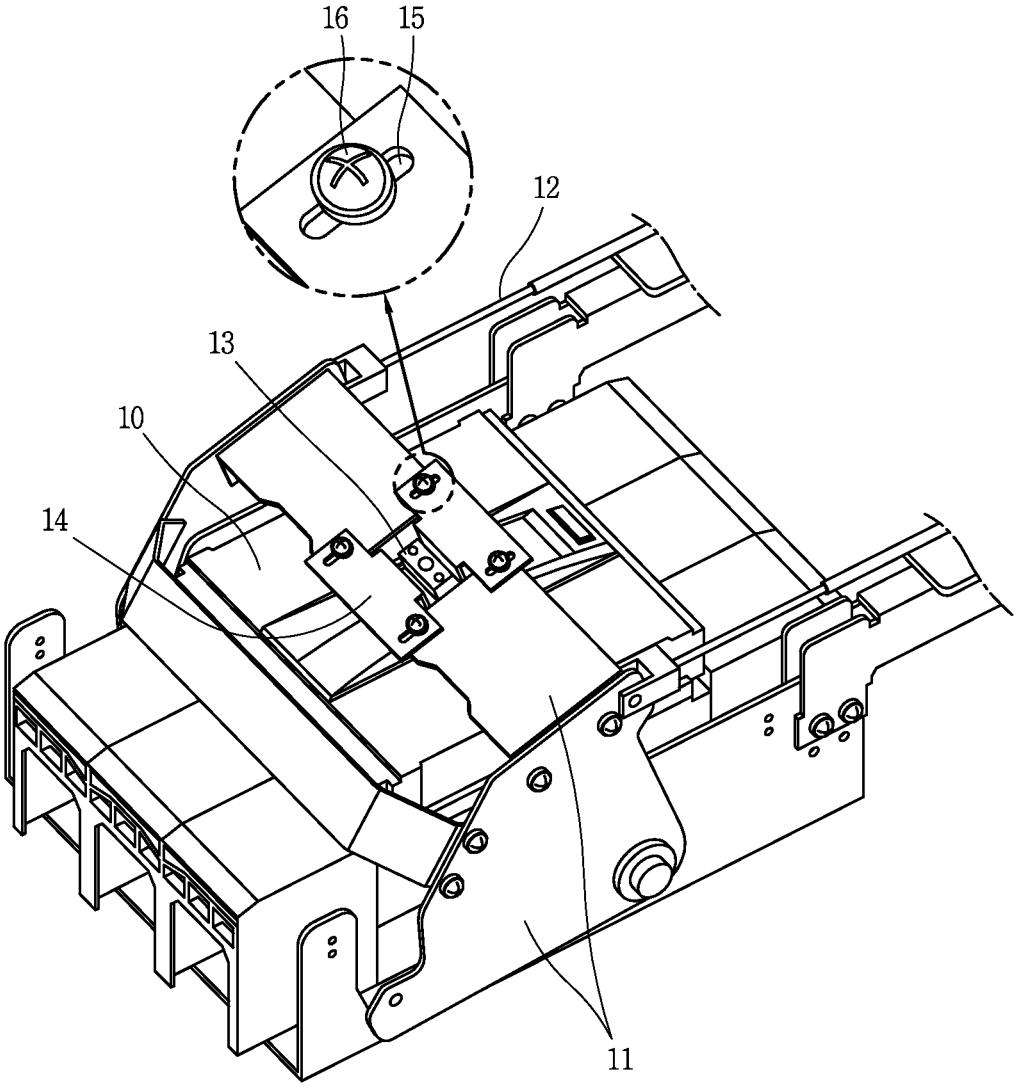
FIG. 1 PRIOR ART
FIG. 1 is a perspective view illustrating a handle operating device of a large capacitor circuit breaker in the related art.
Figure 2:
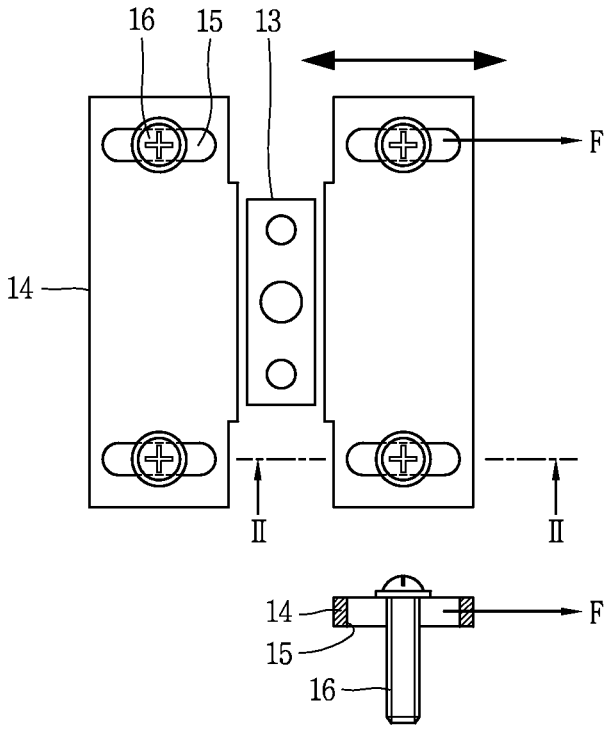
FIG. 2 PRIOR ART
FIG. 2 is a schematic view for explaining a power transfer mechanism to a handle of the circuit breaker in a handle operating device of a large capacity circuit breaker in the related art.
Figure 3:
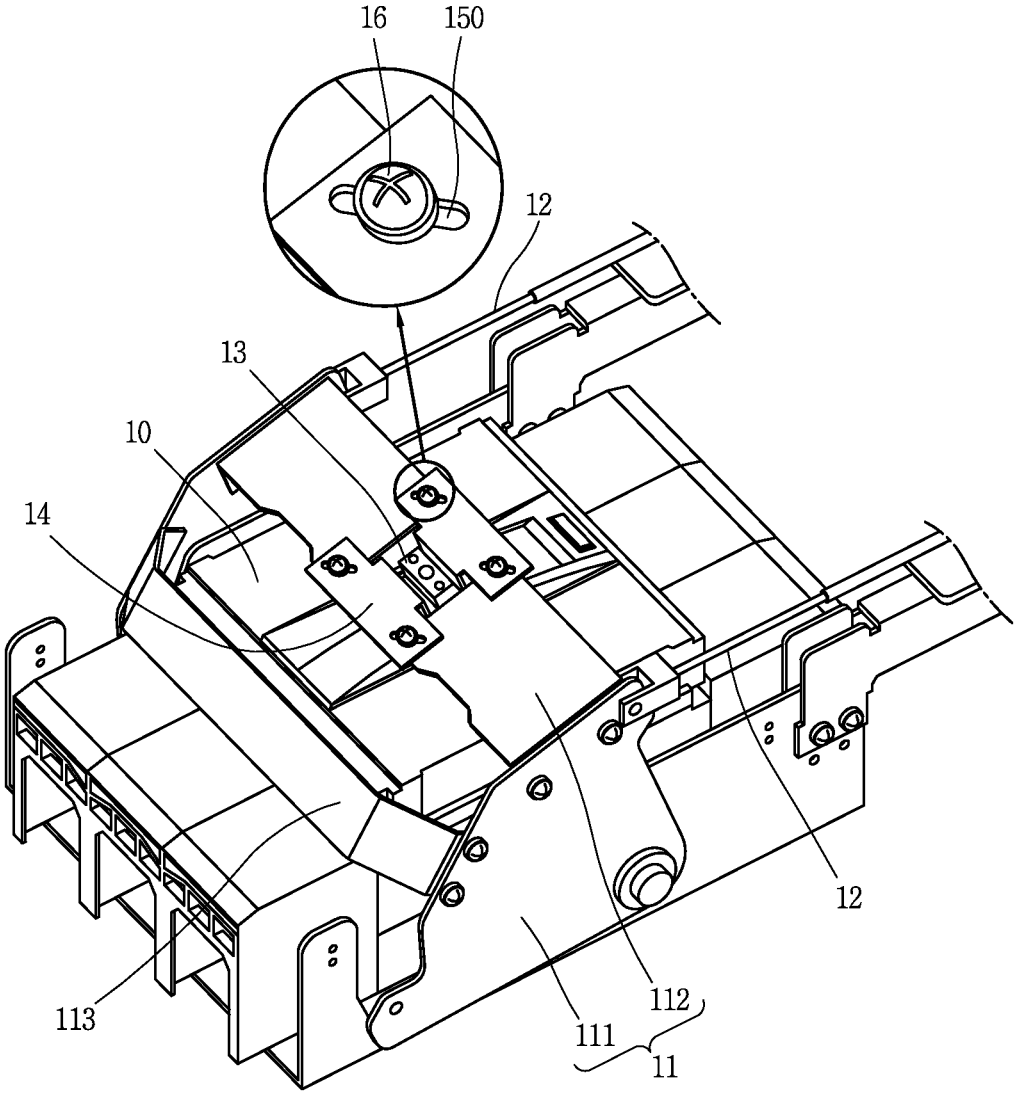
FIG. 3 is a perspective view illustrating a handle operating device for a circuit breaker according to a first embodiment of the present disclosure.
Figure 4:
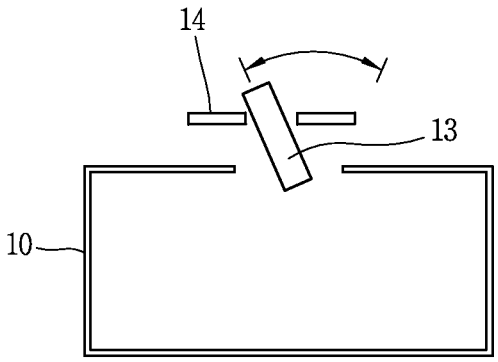
FIG. 4 is a schematic view illustrating the operation state of a circuit breaker handle as a side view in FIG. 3.

FIG. 3 attached herewith is a perspective view illustrating a handle operating device for a circuit breaker according to a first embodiment of the present disclosure, and FIG. 4 is a schematic view illustrating the operation state of a circuit breaker handle as a side view in FIG. 3.

The present disclosure relates to a handle operating device for a circuit breaker capable of reducing a load on screws 16 during the operation of a circuit breaker handle 13 using an external operating handle.

The handle operating device for a circuit breaker as a device for the user's convenience may maximize the convenience of use when applied to a large capacity circuit breaker.

For example, when operating the handle 13 of the large capacity circuit breaker, it may be possible to move an on position to an off position or vice versa using an external operating handle.

The external operating handle may be used by employing publicly known technologies, and thus the description of the detailed structure and operation thereof will be omitted.

A handle operating device for a circuit breaker according to the present disclosure may include a connecting rod 12, a stationary frame 17, a movable frame 11, a movable member 14, and the like.

For the connecting rod 12, an end portion of the connecting rod 12 is connected to the external operating handle and the other end portion of the connecting rod 12 is connected to the movable frame 11 to transfer power generated from the external operating handle to the movable frame 11.

The stationary frame 17 is disposed in the shape of surrounding a base surface of the circuit breaker case 10, for example, a bottom and a lateral surface of the base, and the circuit breaker is fixed to the stationary frame 17.

The movable frame 11 may include side plates 111 hinge-coupled to both lateral surfaces of the circuit breaker case 10, a connecting rod 113 connected between the side plates 111, and a movable rod 112 provided between the side plates 111.

The side plates 111 may be formed in a triangular shaped plate structure, and disposed to be separated from each other in the vertical direction of the operating direction of the circuit breaker handle 13, and one corner of the triangular plate 111 is hinge-coupled to a lateral surface of the circuit breaker case 10 to be rotated in the operating direction of the circuit breaker handle 13.

The connecting rod 113 has a plate structure having a small width and a long length to maintain a predetermined gap between the side plates 111.

The moving rods 112 are provided on both side plates 111, respectively, in a plate structure, and one side length directional surface of each movable plate 112 is disposed to be separated from the connecting rod 113 in the handle operating direction of the circuit breaker, and one side width directional surface of each movable plate 112 is disposed to be separated in the vertical direction of the handle operating direction of the circuit breaker. The movable rod 112 having such a connecting relation is rotated in the operating direction of the circuit breaker handle 13 along with the side plates 111.

The movable members 14 are connected between the movable rods 112, and disposed to be separated from each other in the handle operating direction with the circuit breaker handle 13 therebetween, and thus rotated in the handle operating direction of the circuit breaker along with the movable rods 112 and side plates 111.

In this manner, an end portion of the circuit breaker handle 13 is inserted between the separated movable members 14, and the inserted circuit breaker handle 13 may move from an on position to an off position or vice versa by the rotated movable members 14.

Figure 5:
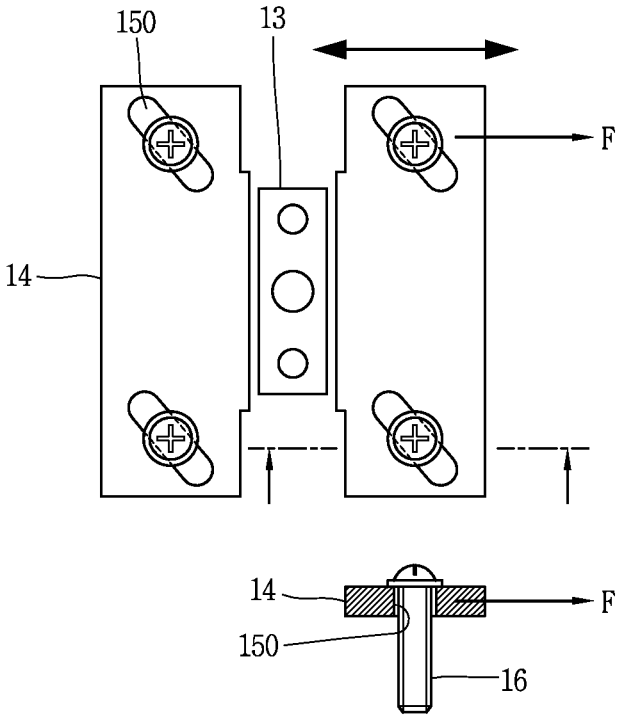
FIG. 5 is a schematic view for explaining a power transfer mechanism to a circuit breaker handle in a handle operating device for a circuit breaker according to the present disclosure.
Figure 6:
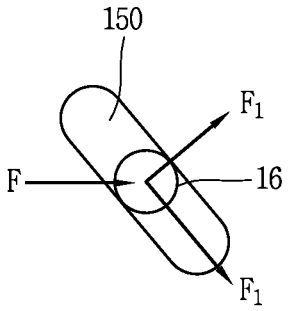
FIG. 6 is a schematic view illustrating the component loads of a force in a slot hole skew structure according to the present disclosure.

FIG. 5 attached herewith is a schematic view for explaining a power transfer mechanism to a circuit breaker handle 13 in a handle operating device for a circuit breaker according to the present disclosure, and FIG. 6 is a schematic view illustrating the component loads of a force in a slot hole 150 skew structure according to the present disclosure.

Here, the movable member 14 may include slot holes 150 formed in an inclined manner at both end portions thereof, respectively, to finely adjust a gap of the circuit breaker handle 13 between the movable rods 112.

The slot hole 150 denotes the shape of a hole having an elongated length in a direction compared to the width thereof.

The long axis direction of the slot hole 150 is disposed to be inclined at a predetermined angle from the handle operating direction of the circuit breaker.

The reason for which the long axis direction of the slot hole 150 is disposed to be inclined contrary to the related art is to prevent the screw 16 from being pushed out from the slot hole 150 when an operating force acts in the handle operating direction.

More specifically, a fastening force of the screws 16, for example, round Phillips head screws, for fastening the movable member 14 to the movable rod 112 acts in a direction from bolt head to the bolt stem, namely, in a direction perpendicular to the long axis direction of the slot hole 150, and thus a force preventing the screws 16 from being pushed out is a frictional force. Frictional force is the product of a friction coefficient of the contact surface and a normal force, and according to the present disclosure, the friction coefficient of the contact surface is a predetermined value and thus the frictional force is proportional to the normal force. Accordingly, the size of a frictional force preventing the screws 16 from being pushed out is increased as increasing the fastening force of the screws 16 which is a force corresponding to the normal force.

However, there is a limit in increasing a frictional force for preventing the screws 16 from being pushed out. It is because of a fastening force of the screws 16. As described in the related art, a fastening force is predetermined according to the types of screws 16, and in case of a hexagonal wrench bolt for which a hexagonal groove is formed on the bold head, it is expensive and thus not helpful for cost reduction. Furthermore, a bolt tends to be loose since the fastening force is gradually weakened as time passes, and the handle operating force of the circuit breaker is constant, and thus it is not a fundamental solution to overcome the phenomenon of screws 16 of being pushed out with a fastening force of the hexagonal wrench bolt by the handle operating force of the circuit breaker.

Accordingly, as a fundamental solution, a load on the screws 16, namely, an operating force being transferred from the external operating handle to the screws 16 during the operation of the circuit breaker handle may be reduced, thereby preventing the screws 16 from being pushed out.

For example, when the direction of the screws 16 of being pushed out is the same as the operating direction of the handle operating force, the handle operating force is transferred 100 percent to the screws 16 in the direction of the screws 16 of being pushed out. However, in case where the direction of the screws 16 of being pushed out is disposed to be inclined from the operating direction of the handle operating force, when the screw 16 is pushed out from the slot hole 150 by the operation of the handle operating force during the operation of the handle 13 it receives intervention from the movable member 14 around the slot hole 150. In other words, in the related art, the long axis direction of the slot hole 150 is the same as the operating direction of the handle operating force, and thus there is no intervention for the movement of the screws 16, but according to the present disclosure, the long axis direction of the slot hole 150 is crossed with the operating direction of the handle operating force in an inclined manner, therefore receiving intervention.

In this case, as illustrated in FIG. 6, the handle operating force "F" is divided into a force "F1" in the vertical direction of the long axis direction of the slot hole 150 and a force "F2" in the long axis direction of the slot hole 150 (F=F1+F2). Here, the component load "F2" on the screws 16 is far less than "F".

In other words, the component load "F2" on the screws 16, which is a fundamental force generating the phenomenon of the screws 16 of being pushed out, is far less than the handle operating force, thereby preventing the screws 16 from being pushed out by the handle operating force during the handle operation in the related art.

Figure 7:
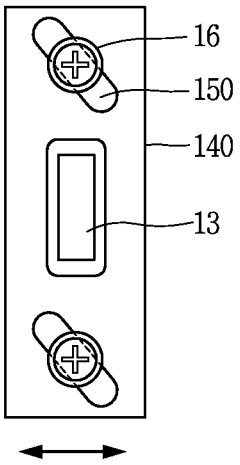
FIG. 7 is a plan view illustrating the skew structure of a movable member and slot holes according to a second embodiment of the present disclosure.

FIG. 7 is a plan view illustrating the skew structure of a movable member 140 and slot holes 150 according to a second embodiment of the present disclosure. The direction of arrow in FIG. 7 is a handle operating direction.

Referring to FIG. 7, the movable member 140 according to a second embodiment is not a separated structure with the circuit breaker handle 13 therebetween as in the first embodiment but an integrated structure, and is provided with an insertion hole therein to allow the circuit breaker handle 13 to be inserted through the insertion hole.

In this manner, the integrated movable member 140 may adjust a gap between the movable member 140 and circuit breaker handle 13 through the position adjustment of the screws 16 within the slot hole 150. However, a front and a rear gap between the movable member 140 and handle 13 are not separately adjusted around the circuit breaker handle 13 within the insertion hole as in the first embodiment, and the front gap and the rear gap between the movable member 140 and handle 13 act with each other. For example, the rear gap between the movable member 140 and handle 13 is reduced when increasing the front gap between the movable member 140 and handle 13, and on the contrary, the front gap between the movable member 140 and handle 13 is reduced when increasing the rear gap between the movable member 140 and handle 13. In such an integrated type movable member 140, the number of slot holes 150 may be reduced compared to a separated type movable member 14, thereby simplifying the structure and reducing the cost.

In addition, the location of the slot holes 150 in the movable member 140 according to the second embodiment may be disposed to be separated from each other in the vertical direction of the operating direction of the circuit breaker handle 13.

Figure 8:
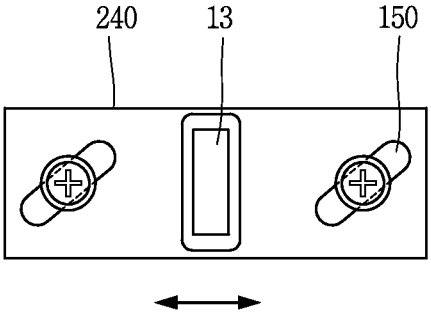
FIG. 8 is a plan view illustrating the skew structure of a movable member and slot holes according to a third embodiment of the present disclosure.

FIG. 8 is a plan view illustrating the skew structure of a movable member 240 and slot holes 150 according to a third embodiment of the present disclosure. The direction of arrow in FIG. 8 is a handle operating direction.

The movable member 240 according to the third embodiment is an integrated type as in the second embodiment, thereby obtaining a cost reduction effect with a simple structure. However, contrary to the second embodiment, the location of the slot holes 150 may be disposed to be separated from each other in the operating direction of the circuit breaker handle 13.

Although the preferred embodiments of the present invention have been described in detail, the rights scope of the present invention is not limited to the embodiments and various modifications and improvements thereto made by those skilled in the art using the basic concept of the present invention as defined in the accompanying claims will fall in the rights scope of the invention.

What is claimed is:

1. A handle operating device, comprising:

a connecting rod configured to transfer power for operating a manual operating handle that is used for manually operating on/off of a circuit breaker from outside;

a movable frame connected to the connecting rod to be movably coupled to an outer surface of a circuit breaker case in a direction parallel to an operating direction of the manual operating handle;

a movable member provided at the movable frame in an interlocking manner to move the manual operating handle;

slot holes formed on the moving member in an inclined manner from the operating direction of the manual operating handle to adjust a gap of the manual operating handle; and a fastening member inserted into one of the slot holes to fasten the movable member to the movable frame, wherein the movable member is provided with an insertion hole therein to insert an end portion of the manual operating handle, and wherein a rear gap between the movable member and the manual operating handle is reduced when increasing a front gap between the movable member and the manual operating handle, or the front gap between the movable member and the manual operating handle is reduced when increasing the rear gap between the movable member and the manual operating handle.

2. The handle operating device of claim 1, wherein the fastening member is a screw.

3. The handle operating device of claim 1, wherein the fastening member is configured to finely adjust an operating distance of the manual operating handle according to a position at which the fastening member is fixed on the one of the slot holes.

4. The handle operating device of claim 1, wherein:

the movable frame comprises:

side plates coupled to an outer surface of the circuit breaker case, each side plate having a hinge structure, and connected to an end portion of the connecting rod to be rotated in the same direction as the operating direction of the manual operating handle; and movable rods connected between the side plates to be operated along with the side plates; and the movable member is connected between the movable rods.

5. The handle operating device of claim 1, wherein the slot holes are formed in parallel to each other with a gap therebetween.

6. The handle operating device of claim 1, wherein the slot holes are formed on the movable member to be separated from each other in a vertical direction of the movement of the movable member.

7. The handle operating device of claim 1, wherein the slot holes are formed on the movable member to be separated from each other in a movement direction of the movable member.

* * * * *